US007475649B2

(12) United States Patent
Shepherd

(10) Patent No.: US 7,475,649 B2
(45) Date of Patent: Jan. 13, 2009

(54) DAVIT SYSTEM FOR SMALL BOATS

(76) Inventor: John D. Shepherd, 15765 Annico Dr., Lockport, IL (US) 60442

( * ) Notice: Subject to any disclaimer, the term of this patent is extended or adjusted under 35 U.S.C. 154(b) by 0 days.

(21) Appl. No.: 11/827,617

(22) Filed: Jul. 12, 2007

(65) Prior Publication Data

US 2008/0017096 A1 Jan. 24, 2008

Related U.S. Application Data

(60) Provisional application No. 60/831,636, filed on Jul. 18, 2006.

(51) Int. Cl.
*B63B 35/40* (2006.01)

(52) U.S. Cl. ..... 114/259; 114/366

(58) Field of Classification Search ..... 114/365–380, 114/44–48, 259
See application file for complete search history.

(56) References Cited

U.S. PATENT DOCUMENTS 2,294,864 A * 9/1942 Palmer ..... 114/368
2,506,085 A * 5/1950 Howard ..... 114/365
4,864,951 A * 9/1989 Koepp, Jr. ..... 114/44
4,961,398 A * 10/1990 Anderson et al. ..... 114/368
4,964,358 A * 10/1990 Sandrow ..... 114/368
5,133,275 A * 7/1992 Maurizio ..... 114/259
5,193,479 A * 3/1993 Bielefeld ..... 114/366
5,483,912 A * 1/1996 Thomas ..... 114/259
2004/0099198 A1 * 5/2004 Blackmore ..... 114/259

* cited by examiner

*Primary Examiner*—Ed Swinehart
(74) *Attorney, Agent, or Firm*—Greer, Burns & Crain, Ltd.

(57) ABSTRACT

A cradle is shaped to accommodate the hull of a small boat such as dinghy, personal watercraft or other type of boat. A support is mounted to a deck such a boat, pier or dock deck. The cradle is pivotally mounted to the support and can be moved to a loading position in which the cradle is generally vertical, or inclined to horizontal, and an outer portion of the cradle is at the water adjacent to the deck. The small boat is moved upon the water against the cradle. A pair of lines extend from the support and are trained through an inner portion of the cradle. The free ends of the lines are attached to the boat, and the lines are drawn toward the support, for example with a hand wheel or hand winch. The boat is pulled toward the support while remaining in a generally horizontal orientation. The boat pivots the cradle from the loading position to a generally horizontal storage position on the deck where the boat and cradle are secured by the lines.

18 Claims, 5 Drawing Sheets

DAVIT SYSTEM FOR SMALL BOATS

This application claims the benefit of U.S. Provisional Application 60/831,636, filed Jul. 18, 2006.

FIELD OF THE INVENTION

The present invention relates to an improved davit system for small boats.

DESCRIPTION OF THE PRIOR ART

Often it is desirable to lift a small boat, such as a dinghy or personal watercraft, from the water onto the deck of a larger boat or onto the deck or floor of a pier or dock, and secure it in place for storage or transport. Although various boat storage and davit systems are known, systems presently available have disadvantages.

Many known davit or boat securing systems attach to a boat at a single point. As a result, the boat is not secured against movement, and water currents or turbulence can interfere with the safe raising and storage of a boat, particularly in rough seas. In addition, many known systems do not provide a safe and secure place for the user, and some even require the user to lean out over the water to make an attachment to a boat in the water.

Another problem with many known boat storage systems is that they require auxiliary straps or lines for securing the boat in place for storage. This is another safety issue in rough water conditions. With some widely used tilt up systems, the boat is stored for transit in a vertical position. A problem with this is that equipment, such as motors, fuel containers, oars and supplies must be removed from the boat and stowed separately.

Some known davit or storage systems are very complex. For example, some require powered winches, or, in the case of hang type davits, sturdy structural support. Many known systems are difficult to use, requiring excessive user strength, and requiring separate equipment for first lifting and then securing a boat. Some known systems have bracing or other structure that obstructs the area around the boat storage location.

SUMMARY OF THE INVENTION

A primary object of the present invention is to provide an improved davit system for lifting and storing small boats such as dinghies, personal watercraft or others. Other objects are to provide a davit system that securely positions the boat for lifting and storage and that can be safely used even in rough water conditions; to provide a davit system that lifts and secures a boat for storage and transit without the need to attaching auxiliary lines or straps; to provide a davit system that is easy and safe to use by a single user in all weather conditions and that does not require external power or a large amount of user strength; to provide a davit system that does not require that equipment such as an outboard motor, fuel container, oars and the like be removed; to provide a davit system that is compact and does not obstruct the region around the boat storage location; and to provide a davit system overcoming problems of known systems.

In brief, in accordance with the present invention, there is provided a davit system for lifting a boat from the water and securing it to a deck having an edge near the water. The davit system includes a cradle shaped to receive the hull of the boat. The cradle is mounted for movement relative to said support between a loading position in which the cradle is inclined to horizontal and a storage position in which the cradle is generally horizontal. The cradle has an inner portion and an outer portion that extends downward from the deck in the loading position of the cradle. A drive system includes a line and a drive member for pulling the line toward the support. The line has a portion adapted to be attached to the boat when the cradle is in the loading position and the boat is adjacent the outer portion of the cradle.

BRIEF DESCRIPTION OF THE DRAWING

The present invention together with the above and other objects and advantages may best be understood from the following detailed description of the preferred embodiments of the invention illustrated in the drawings, wherein.

DETAILED DESCRIPTION OF THE PREFERRED EMBODIMENT

Having reference now to the drawings, there is illustrated a davit system generally designated as 10 and constructed in accordance with the principles of the present invention. As illustrated, the davit system 10 is mounted on a deck 12 of a large watercraft, and specifically on the rear swim deck 12 of a motorboat 14. The davit system 10 of the present invention can be used in many other applications, including decks of other types of watercraft, floating piers, docks and other locations where boat storage is desired. The illustrated davit system 10 is used to lift and store an inflatable dinghy 16, but can be used for any small boats such as other types of dinghies, rowboats, canoes, personal watercraft and the like.

Figure 7:
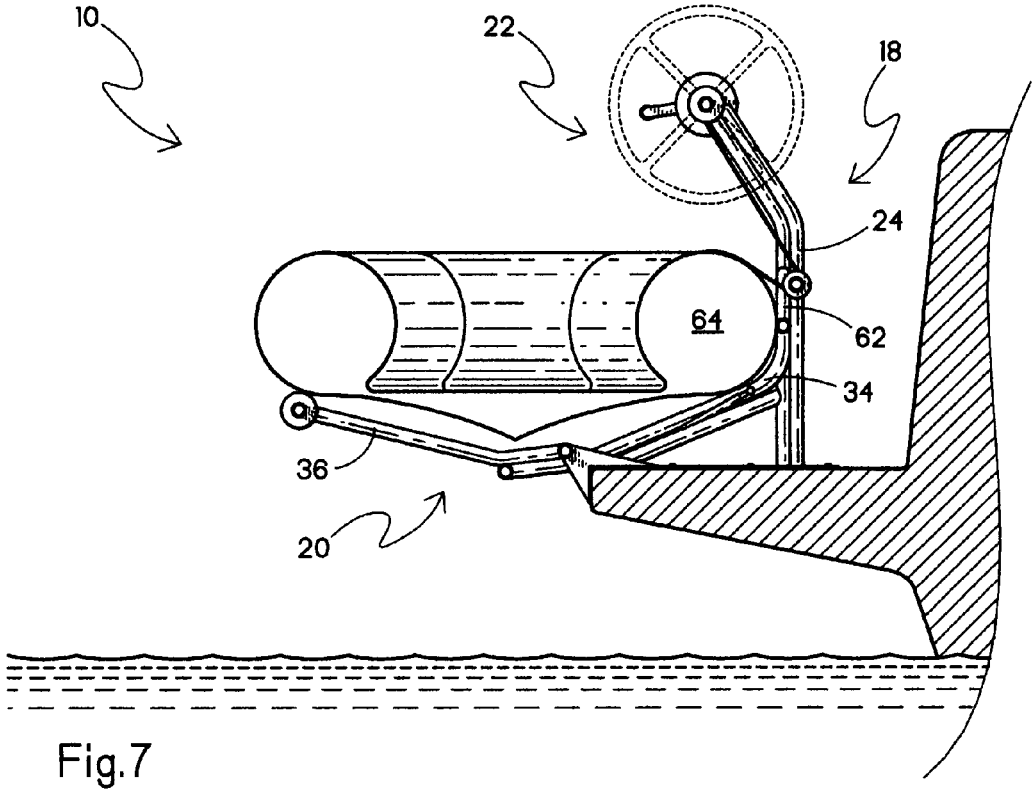
FIG. 7 is a view like FIGS. 4-6 showing the davit system in its raised storage position with a stowed and secured dinghy in place.

In general, the davit system 10 includes a support assembly 18 mounted to the deck 12. A cradle assembly 20 carried by the support assembly 18 receives the dinghy 16 and supports it as it is lifted and secured. A drive system 22 is used to move the cradle assembly 20 and dinghy 16 from an initial loading position (FIG. 3) to a secured storage position (FIG. 7).

The support assembly 18 includes a pair of stanchions 24 that are spaced part on and extend generally vertically from the deck 12. Each stanchion 24 extends upward from a deck mount plate 26 that is attached to the deck 12 with suitable fasteners. The forward end of each deck mount plate 26 has a downward extending lip or flange 28 that overlies the edge of the deck 12 for locating the davit system 10 in the proper position for use. Struts 30 brace the stanchions 24. A crossbar 32 extends between the stanchions 24.

The cradle assembly 20 includes an inner frame 34 and an outer frame 36. The inner frame 34 includes a pair of similar, spaced apart side rails 38. A first crossbar 40 extends between the rails 38 near their free ends, and a second crossbar 42 extends between the rails 38 near their opposite ends, providing a rigid, generally rectangular structure. The outer frame 36 also includes a pair of similar, spaced apart side rails 44. A first crossbar 46 extends between the rails 44 at their free ends, and a second crossbar 48 extends between the rails 44 at their opposite ends.

A pivot bracket 50 is mounted on each deck plate 26 providing a pivot support point 52 (FIG. 3) at an elevation slightly above the surface of the deck 12 and slightly outboard of the edge of the deck 12. Each side rail 38 of the inner frame 34 is pivotally supported at the pivot point 52 a location spaced a small distance from the second crossbar 42. The outer frame is pivotally supported at the pivot point 52 at the intersections of the side rails 44 and the second crossbar 48.

As a result of the pivotal mounting of the inner and outer frames 34 and 36, the frames are able to pivot relative to the deck 12 of the motorboat 14, and also are able to pivot relative to one another. The range of pivotal movement of the inner and outer frames 34 and 36 is limited. The inner frame 34 can pivot in the FIG. 3 clockwise direction to a storage position nested against the stanchions 24. When the inner frame is in this storage position, the outer frame 36 can pivot in the FIG. 3 clockwise direction to an empty, folded, standby position seen in FIG. 1. In this position, the cradle assembly 20 is collapsed into a compact, non obstructing configuration.

Figure 2:
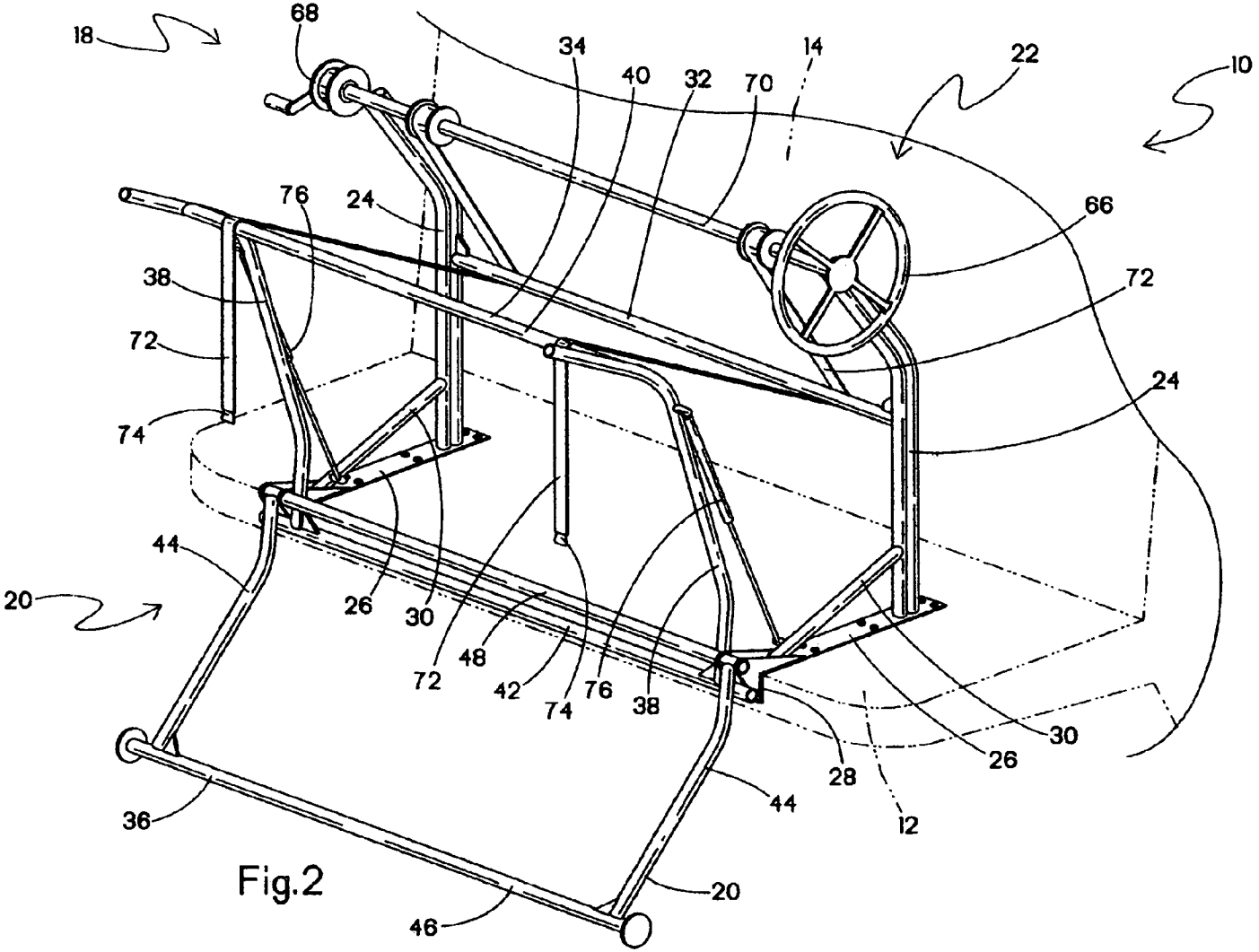
FIG. 2 is a perspective view of the davit system in its unfolded and lowered position, ready to receive a boat for lifting and storage.
Figure 3:
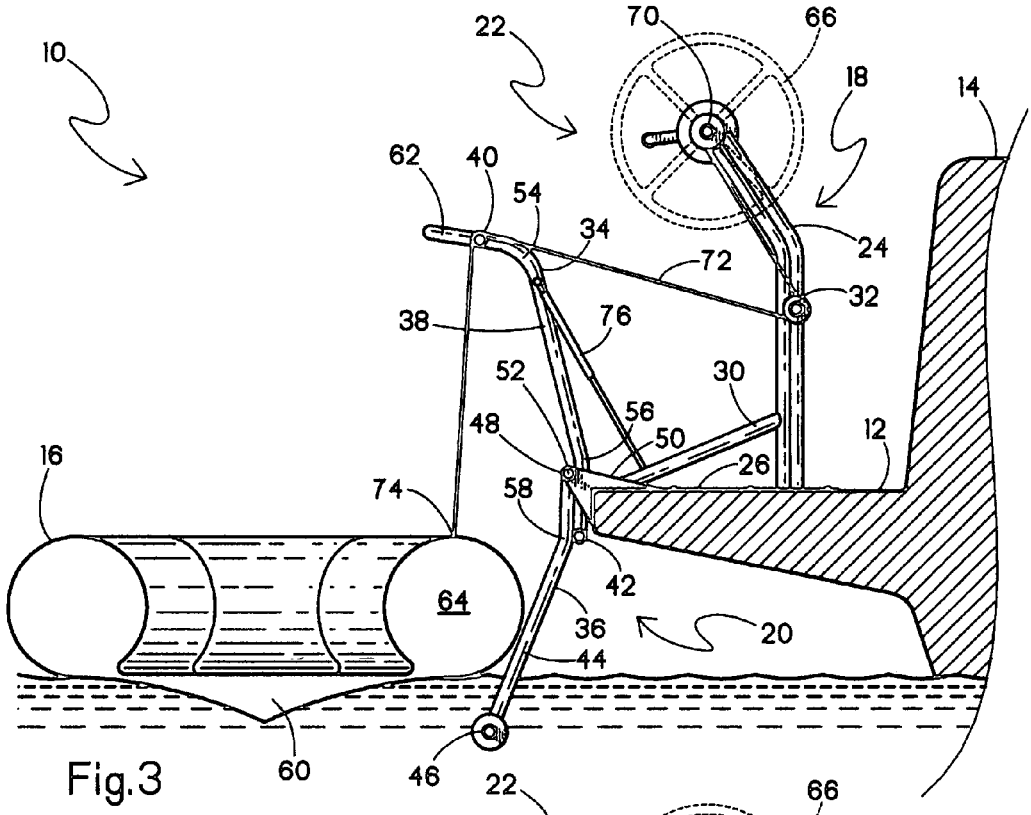
FIG. 3 is a side elevational view of the davit system in its unfolded and lowered position, ready to receive a boat for lifting and storage, with a dinghy in place to be lifted and stored.

In order to use the davit system 10 for lifting and storing the dinghy 16 or other small boat, the outer frame 36 is pivoted in the FIG. 3 counterclockwise direction to an unfolded position seen in FIGS. 2 and 3. This pivoting movement of the outer frame 36 relative to the inner frame 34 is limited by contact of the side rails 44 of frame 36 against the second crossbar 42 of frame 34. In this relative position of the frames 34 and 36, the cradle assembly 20 is fully open, ready to receive the dinghy 16.

As best seen in FIG. 3, the side rails 38 of the inner frame 34 include bends or elbows 54 near the first crossbar 40, and second, smaller bends or elbows 56 near the pivot points 52. The side rails 44 of the outer frame 36 include bends or elbows 58 near the contact points of rails 44 with the second crossbar 48 of the inner frame 34. The bends 54 and 56 provide the cradle assembly 20 with a shape similar to the shape of the bottom 60 of the dinghy 16 so that the dinghy 16 nests in the cradle assembly 20. The bends 54 define end stop segments 62 of the side rails 38. The movement of the dinghy 16 into the cradle assembly 16 is limited by contact of the inflatable side tube 64 of the dinghy against the stop segments 62 and against the first crossbar 40 of the inner frame 34. If desired the cradle assembly 20 may have other shapes conforming with other types and shapes of boats to be lifted and stored.

Figure 1:
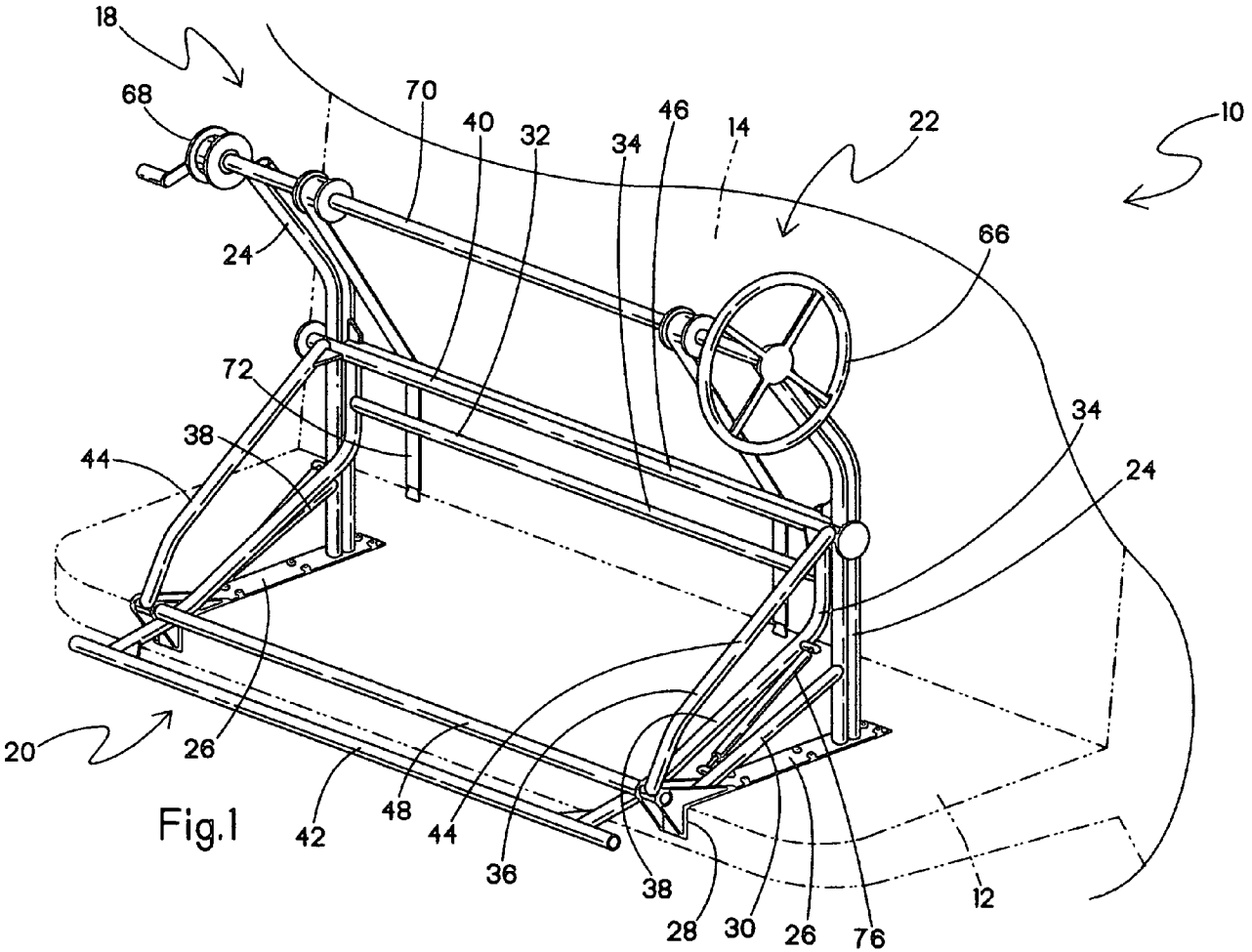
FIG. 1 is a perspective view of a davit system constructed in accordance with the present invention, showing the davit system in its empty, folded, standby position.
Figure 4:
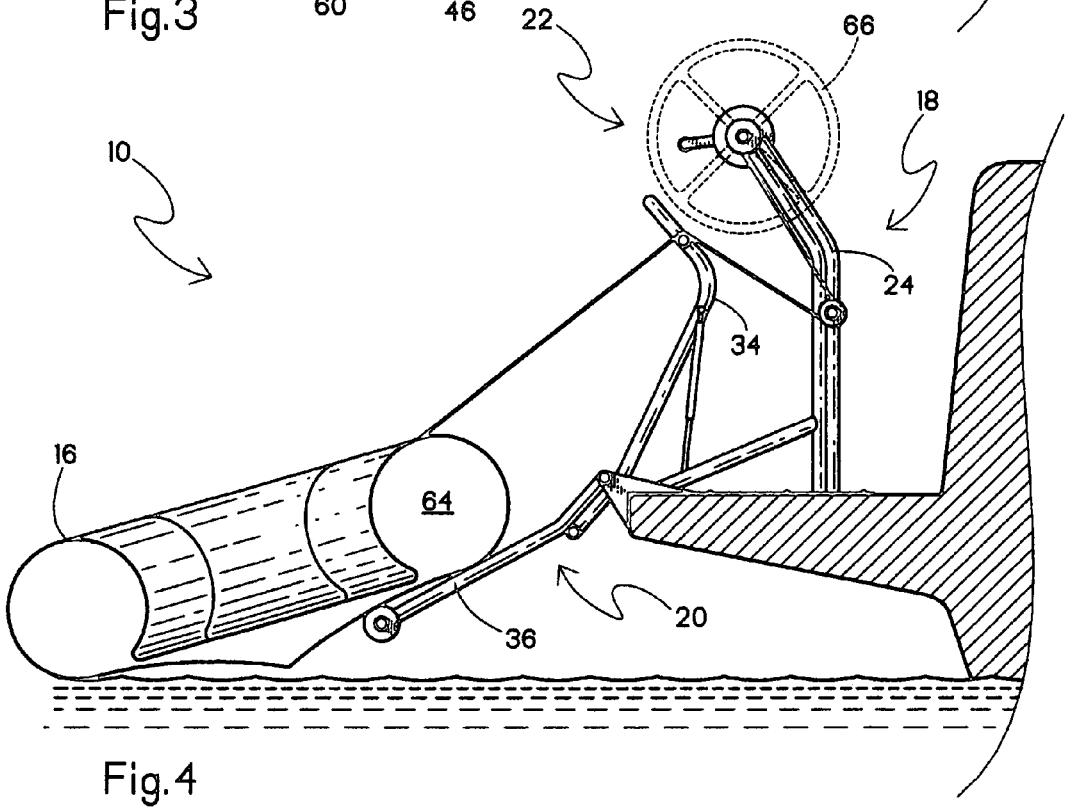
FIGS. 4-6 are views like FIG. 3 showing the davit system moved in increments from the unfolded and lowered loading position toward the raised storage position.
Figure 5:
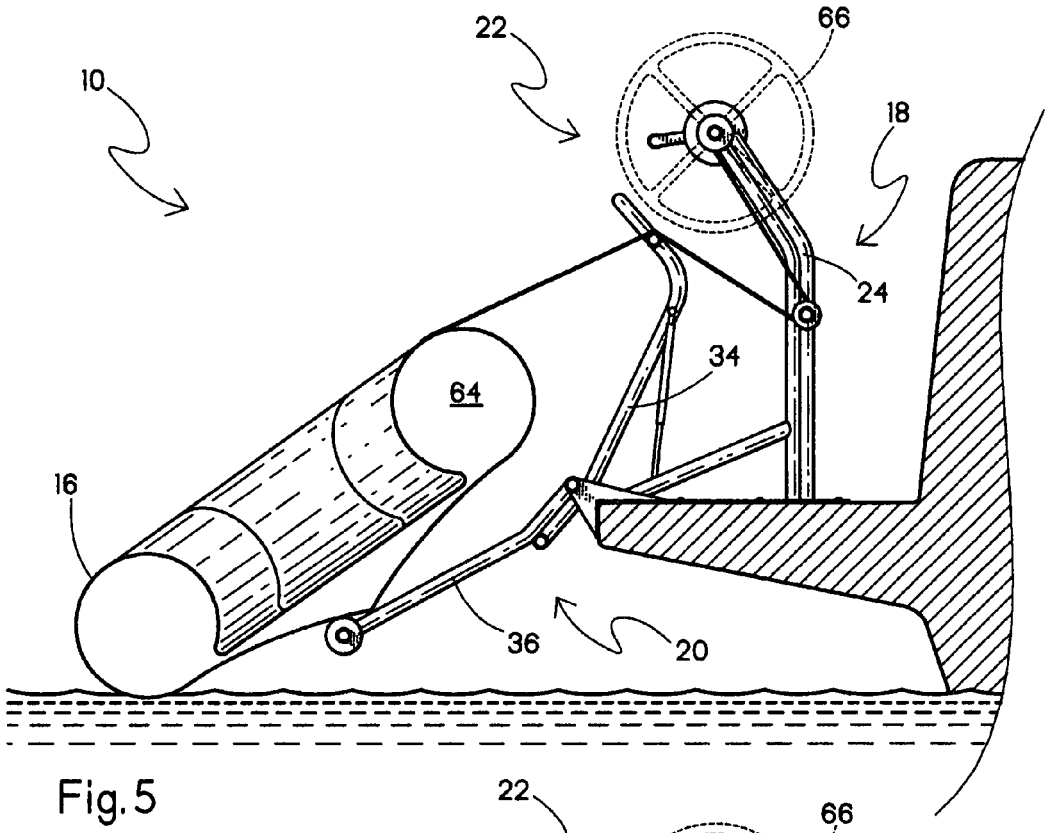
Figure 6:
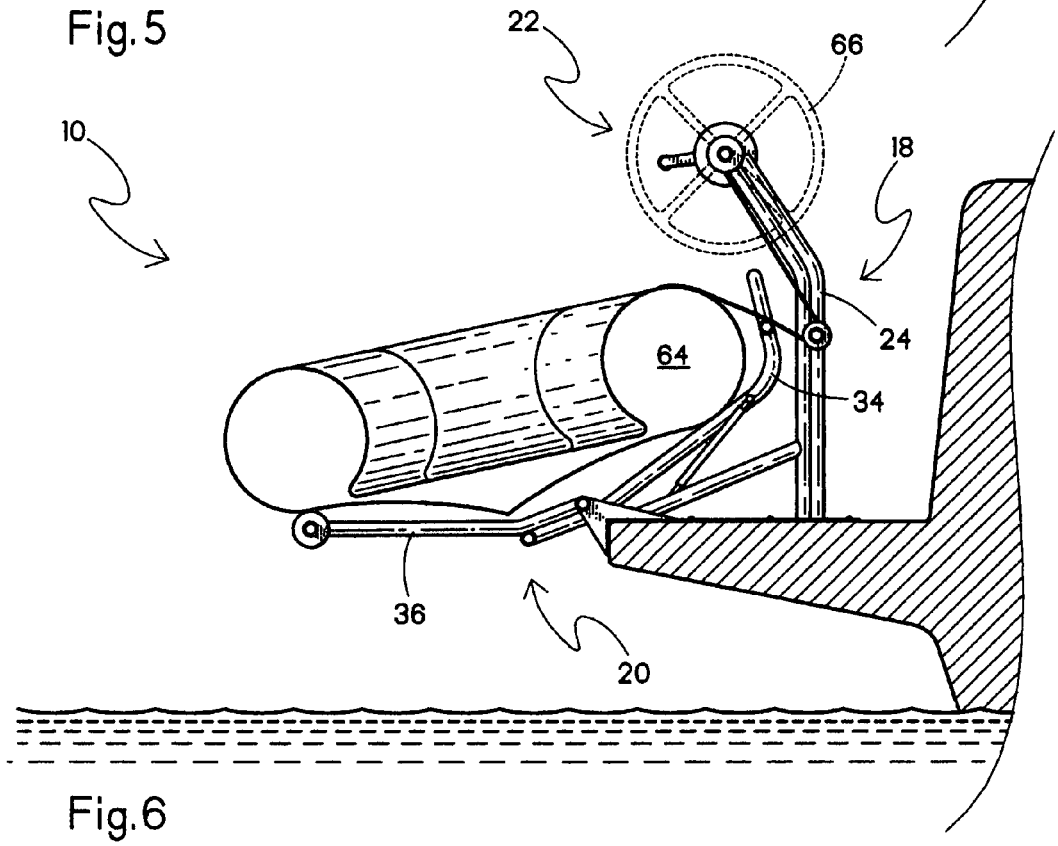

The drive system 22 is used to move the cradle assembly 20 and the dinghy 16 from the initial attachment position of FIG. 3 sequentially through the positions seen in FIGS. 4-6 to the final stored position seen in FIG. 7. The drive system 22 includes a source of force such as the hand wheel 66 seen in FIGS. 3-7. Alternatively a hand operated winch 68 such as seen in FIGS. 1 and 2 may be used. Although both a hand wheel 66 and a manual winch 68 are seen in FIGS. 1 and 2, only a single source of operating force is needed. Other devices as a powered winch may be used, but since a large operating force is not required, a powered winch is not necessary.

The winch 68 or other source of operating force rotates a drive bar 70 that extends between and is supported by the stanchions 24. A pair of spaced apart lift straps or lines 72 are attached to the drive bar 70. If desired these straps 72 may be attached to take up reels or drums on the drive bar 70. The straps 72 extends down from the drive bar 70 and then extend around the crossbar 32 and around the crossbar 40 as seen in FIG. 3. The straps 72 can be placed directly around the crossbars 32 and 40, or if desired suitable rollers or pulleys may be provided.

The winch 68 or other source of operating force rotates a drive bar 70 that extends between and is supported by the stanchions 24. A pair of spaced apart lift straps or lines 72 are attached to the drive bar 70. If desired these straps 72 may be attached to take up reels or drums on the drive bar 72. The straps 72 extend down from the drive bar 70 and then extend around the crossbar 32 and around the crossbar 40 as seen in FIG. 3. The straps 72 can be placed directly around the crossbars 32 and 40, or if desired suitable rollers or pulleys may be provided.

Each strap 72 has a free end 74 that is attached to the dinghy 16. For example, the dinghy 16 may have suitable attachment points, or in the alternative, attachment hardware can be fixed in place to the side tube 64 of the dinghy 16. The free lift strap ends 74 can be provided with mating hardware, for example suitable hooks or dips. Alternatively, the straps or lines 72 can be simply tied around or to the dinghy 16 or other boat.

In order to operate the davit system 10 to lift and store the dinghy 16, first the cradle assembly is prepared by moving the frames 34 and 36 to the extended position seen in FIGS. 2 and 3. In this position, the strap ends hang from the crossbar 40 in a convenient location for use.

The user typically is in the dinghy at this point. The user maneuvers the dinghy along the surface of the water to the attachment position seen in FIG. 3 where the tube 64 or side or the dinghy abuts against the cradle assembly 20, and specifically against the side rails 44 of the outer frame 36. The user then attaches the strap ends 74 to the dinghy 16. When this is done, the pair of straps 72 provide a two point connection between the deck 12 and the dinghy 16 so that the dinghy is held in position upon the water next to the deck 12. Even in rough or windy conditions, the user can then easily and safely climb from the dinghy 16 onto the deck 12, using the support assembly 18, and in particular the stanchions for hand holds.

When the user is on the deck 12, the drive system 22 is operated. This can be done by the same user who positions the dinghy. The winch 68 (or hand wheel 66) rotates the drive bar 70 and the straps 72 are wrapped onto the drive bar 70. As a result, two simultaneous movements take place. First, the straps 72 pull the dinghy 16 upward toward the crossbar 40 and the side tube 64 of the dinghy 16 is lifted upward. Simultaneously, the cradle assembly 20 pivots (clockwise as seen in FIGS. 3-7) as the crossbar 40 is pulled toward the crossbar 32.

Initially, the dinghy 16 and cradle assembly 20 are in the FIG. 3 initial attachment position. As the straps 70 are wound up onto the drive bar 70 the dinghy 16 and cradle assembly 20 are moved trough the positions seen in FIGS. 4, 5 and 6. The dinghy 16 is initially horizontal (FIG. 3) and then is tilted (counterclockwise as seen in FIG. 3) as it slides into the cradle assembly 20. At the same time, the cradle assembly pivots from its most inclined position (FIG. 3) sequentially to a more horizontal position.

FIG. 7 illustrates the final lifted and stored position. The side tube 64 of the dinghy 16 is pulled by the straps 72 into place against the stop segments 62 of the side rails 44 of the inner frame 34, and the dinghy is securely nested in the cradle assembly 20. The straps 72 pull the crossbar 40 into a final storage position firmly held against the stanchions 24 adjacent the crossbar 32. In this position, the cradle assembly 20 is pivoted to a substantially horizontal position, and the dinghy 16 is held in a horizontal position at an elevation over the deck 12 and spaced well above the surface of the water.

The lines or straps 72 pull the dinghy 16 from the water toward the support assembly 18. The lines 72 are trained through the inner frame 34 of the cradle assembly 20. As the dinghy 16 is pulled upwardly and inwardly, the dinghy 16 contacts the cradle assembly 20 and forces it to pivot from the loading position (FIG. 3) to the storage position (FIG. 7). The cradle pivots from its initial inclined or relative vertical position to its final generally horizontal position, while the simultaneously moving dinghy 16 remains in a generally horizontal orientation throughout its movement.

Because the dinghy is stored horizontally, and is never tilted to a vertical position as it is lifted, any equipment that is secured or placed in the dingy can be left in place. The user does not need to remove and separately store equipment such as oars, a motor, fuel or the like. This simplifies the process of lifting and storing the dinghy, and makes it very convenient when the dinghy is next removed from storage and used.

The straps 72 not only lift and pivot the dinghy 16 and cradle assembly 22, they also secure the dinghy for storage and transport. When the straps 72 are in the final position, they hold the cradle assembly tightly in its final position (FIG. 7) and hold the dinghy securely in place. The winch 68 or other drive power source is simply disabled or locked to prevent unwinding of the straps 72. No additional lines or straps are needed and the dinghy can be safely transported with the motorboat 14, even over rough water. There are no additional lines or equipment obstructing the deck 12.

To return the dinghy 16 to service, the process is reversed. The drive system 22 is operated to return the dinghy 16 and cradle assembly 20 from the FIG. 7 position to the FIG. 3 position. The user can step from the deck 12 into the dinghy 16, unhook the straps 72 and the dingy is ready for immediate use. If the davit system 10 is to be idle for a period of time, it can be moved to the folded, standby position seen in FIG. 1.

If desired, air springs 76 can be used to control and assist the movement of the cradle assembly 20 relative to the support assembly 18. As seen in FIG. 2, the air springs 76 can be connected between the deck mount plates 26 and the side rails 38 of the inner frame 34.

Figure 8:
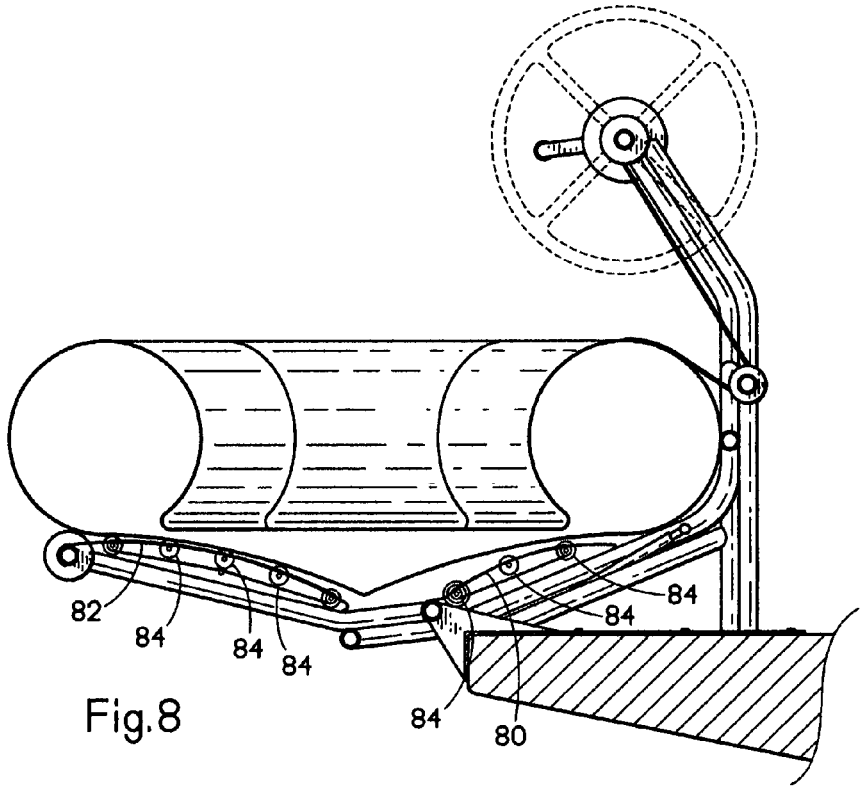
FIG. 8 is a view like FIG. 7 illustrating another embodiment of the invention.

FIG. 8 is a view like FIG. 7 illustrating another embodiment of the invention. In this arrangement, sub frames 78 and 80 are carried respectively by the inner and outer frames 34 and 36. The sub frames 78 and 80 are shaped to match the shape of the bottom 60 of dinghy 16, and are provided with rollers 82 reducing friction and the force needed to move the dinghy 16 and cradle assembly 20 between positions.

What is claimed is:

1. A davit system for lifting a boat from the water and securing it to a deck having an edge near the water, said davit system comprising:

a support having a base adapted to be mounted at the edge of the deck;

a cradle shaped to receive a hull of the boat upon both an inner portion and an outer portion thereof, when in an unfolded position;

said cradle being mounted for movement relative to said support between a loading position in which said cradle is inclined to horizontal and a storage position in which said cradle is generally horizontal, wherein said inner and outer portions of said cradle are each pivotally mounted to said support;

said outer portion of the cradle extending downward from the deck in the loading position of said cradle, wherein said inner and outer portions of said cradle are pivotable relative to one another between a folded position and the unfolded position;

a drive system including a line and a drive member for pulling said line toward said support; and said line having a portion adapted to be attached to the boat when said cradle is in said loading position and the boat is adjacent said outer portion of said cradle.

2. A davit system as claimed in claim 1 comprising a pair of said lines extending from spaced locations along said support.

3. A davit system as claimed in claim 1, said boat sliding into said cradle and remaining relatively horizontal while said cradle pivots from said loading position to said storage position.

4. A davit system as claimed in claim 1, said drive member including a device for winding said line onto said support for pulling the boat and said cradle simultaneously toward said support.

5. A davit system as claimed in claim 4, said device including a hand wheel.

6. A davit system as claimed in claim 4, said device including a hand winch.

7. A davit system as claimed in claim 4, said line being trained from said device through said upper portion of said cradle.

8. A davit system as claimed in claim 7, said portion of said line comprising a free end of said line.

9. A davit system as claimed in claim 4, said cradle including rollers for the hull of the boat.

10. A method for lifting a boat from the water and onto a dock for storage, said method comprising the steps of:

positioning a boat hull receiving cradle into a generally vertical position adjacent to the dock with a portion of the cradle at the water;

moving the boat in the water into contact with the cradle;

attaching a line from a support on the dock to the boat, training the line from the support through an inner portion of the cradle and securing a free end of the line to the boat;

pulling the boat toward the support with the line;

permitting the boat to pull the cradle and tilt the cradle toward the support, whereby the cradle is pivoted on the support; and discontinuing said pulling when the cradle and the boat reach a generally horizontal stored position on the dock.

11. A davit system for lifting a boat from the water and securing it to a deck having an edge near the water, said davit system comprising:

a support having a base adapted to be mounted at the edge of the deck;

a cradle shaped to receive the hull of the boat;

said cradle being mounted for movement relative to said support between a loading position in which said cradle is inclined to horizontal and a storage position in which said cradle is generally horizontal;

said cradle having an inner portion and an outer portion that extends downward from the deck in the loading position of said cradle;

a drive system including a line and a drive member for pulling said line toward said support;

said line having a portion adapted to be attached to the boat when said cradle is in said loading position and the boat is adjacent said outer portion of said cradle;

said cradle being pivotally mounted to said support;

said drive member including a device for winding said line onto said support for pulling the boat and said cradle simultaneously toward said support; and said line being trained from said device through said upper portion of said cradle.

12. A davit system as claimed in claim 11, said inner and outer portions of said cradle each being pivotally mounted to said support.

13. A davit system as claimed in claim 11 comprising a pair of said lines extending from spaced locations along said support.

14. A davit system as claimed in claim 11, said boat sliding into said cradle and remaining relatively horizontal while said cradle pivots from said loading position to said storage position.

15. A davit system as claimed in claim 11, said device including a hand wheel.

16. A davit system as claimed in claim 11, said device including a hand winch.

17. A davit system as claimed in claim 11, said portion of said line comprising a free end of said line.

18. A davit system as claimed in claim 11, said cradle including rollers for the hull of the boat.

* * * * *

UNITED STATES PATENT AND TRADEMARK OFFICE

CERTIFICATE OF CORRECTION

PATENT NO. : 7,475,649 B2
APPLICATION NO. : 11/827617
DATED : January 13, 2009
INVENTOR(S) : Shepherd It is certified that error appears in the above-identified patent and that said Letters Patent is hereby corrected as shown below:

In the Specification:

| | |
|---|---|
| Col. 4, lines 6-15 | Please delete the entire incorrect/duplicate paragraph beginning with "The winch 68….". |
| Col. 4, line 21 | Please delete "dips" and insert "clips" in its place. |

Signed and Sealed this

Nineteenth Day of May, 2009

John Doll

JOHN DOLL
*Acting Director of the United States Patent and Trademark Office*